US012379147B2

(12) United States Patent
Lee et al.

(10) Patent No.: US 12,379,147 B2
(45) Date of Patent: Aug. 5, 2025

(54) REFRIGERATOR

(71) Applicant: SAMSUNG ELECTRONICS CO., LTD., Suwon-si (KR)

(72) Inventors: Seongchan Lee, Suwon-si (KR); Inyong Hwang, Suwon-si (KR); Ilsung Bae, Suwon-si (KR); Jinyoung Song, Suwon-si (KR); Subin Yun, Suwon-si (KR); Wonho Jang, Suwon-si (KR); Youngmin You, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 324 days.

(21) Appl. No.: 18/070,806

(22) Filed: Nov. 29, 2022

(65) Prior Publication Data

US 2023/0204275 A1 Jun. 29, 2023

Related U.S. Application Data

(63) Continuation of application No. PCT/KR2022/015253, filed on Oct. 11, 2022.

(30) Foreign Application Priority Data

Dec. 28, 2021 (KR) ..... 10-2021-0189415

(51) Int. Cl.
*F25D 17/06* (2006.01)
*F25D 17/04* (2006.01)

(52) U.S. Cl.
CPC ..... *F25D 17/062* (2013.01); *F25D 17/045* (2013.01); *F25D 2317/063* (2013.01)

(58) Field of Classification Search
CPC .... F25D 17/062; F25D 17/045; F25D 17/065; F25D 17/06; F25D 17/08;
(Continued)

(56) References Cited

U.S. PATENT DOCUMENTS 9,581,377 B2 2/2017 Kim et al.
11,326,827 B2 5/2022 Heo et al.
(Continued)

FOREIGN PATENT DOCUMENTS

CN 1156665 C 7/2004
CN 104729196 B 3/2017
(Continued)

OTHER PUBLICATIONS

International Search Report dated Feb. 8, 2023 issued in PCT Application No. PCT/KR2022/015253.
(Continued)

*Primary Examiner* — Miguel A Diaz
(74) *Attorney, Agent, or Firm* — STAAS & HALSEY LLP

(57) ABSTRACT

A refrigerator includes a body including an inner case, a first storage compartment, a second storage compartment, a third storage compartment, a first partition between the second storage and the third storage compartments, a second partition between the first and the second storage compartments, a cold air supplier in the third storage compartment to generate cold air, a first communication hole, a second communication hole to face the first communication hole, a first guide duct formed in the first partition to guide the cold air from the first communication hole to the second communication hole, and a second guide duct formed in the second partition to guide the cold air which has flown to the first guide duct, to the second storage compartment, the second guide duct connected to the first guide duct through the second communication hole.

18 Claims, 15 Drawing Sheets

(58) Field of Classification Search
CPC ..... F25D 2317/063; F25D 2317/06; F25D 2317/067; F25D 2317/0671; F25D 2317/0672; F25D 23/069; F25D 11/02; F25D 13/04; F25D 23/12
See application file for complete search history.

(56) References Cited

U.S. PATENT DOCUMENTS

| | | | | |
|---|---|---|---|---|
| 2008/0156029 | A1 | 7/2008 | Ritchie et al. | |
| 2012/0096888 | A1 | 4/2012 | Park et al. | |
| 2013/0000333 | A1* | 1/2013 | Kim | F25D 17/065 62/407 |
| 2021/0285714 | A1 | 9/2021 | Heo et al. | |

FOREIGN PATENT DOCUMENTS

| | | |
|---|---|---|
| JP | 2015-158278 | 9/2015 |
| JP | 2016-186378 | 10/2016 |
| KR | 10-0182630 | 5/1999 |
| KR | 10-0196945 | 6/1999 |
| KR | 10-0453236 | 10/2004 |
| KR | 10-0621239 | 9/2006 |
| KR | 10-0661367 | 12/2006 |
| KR | 10-2011-0089573 | 8/2011 |
| KR | 10-2011-0098413 | 9/2011 |
| KR | 10-2012-0041450 | 5/2012 |
| KR | 10-2021-0092410 | 7/2021 |
| KR | 10-2613454 | 12/2023 |
| WO | WO 2011/105647 A1 | 9/2011 |

OTHER PUBLICATIONS

Written Opinion dated Feb. 8, 2023 issued in PCT Application No. PCT/KR2022/015253.
Office Action dated Nov. 29, 2024 issued in European Application No. EP 22 91 6319.

* cited by examiner

REFRIGERATOR

CROSS-REFERENCE TO RELATED APPLICATION(S)

This application is a continuation application, under 35 U.S.C. § 111(a), of international application No. PCT/KR2022/015253, filed on Oct. 11, 2022, which claims priority to Korean Patent Application No. 10-2021-0189415, filed on Dec. 28, 2021, in the Korean Intellectual Property Office, the disclosure of which is incorporated by reference herein in its entirety

BACKGROUND

1. Field

The disclosure relates to a refrigerator, and more particularly, to a refrigerator including a cold air supply flow path including an improved structure.

2. Description of Related Art

Generally, a refrigerator is an apparatus that includes a storage compartment and a cold air supplier supplying cold air to the storage compartment so as to keep foods fresh. A temperature of the storage compartment is maintained at a temperature within a certain range required to keep the food fresh.

A front side of the storage compartment of the refrigerator is opened, and the open front side is closed by a door to maintain the temperature of the storage compartment.

The storage compartment is divided into an upper compartment, a middle compartment and a lower compartment, and the upper compartment may be used as a refrigerating compartment, the middle compartment may be used as a variable temperature compartment, and the lower compartment may be used as a freezing compartment.

In addition, cold air generated by the cold air supplier arranged in the refrigerating compartment or the freezing compartment is indirectly supplied to the middle compartment.

Therefore, when cold air is supplied from the cold air supplier installed in a space expect for the middle compartment, to the middle compartment, the cold air may flow inefficiently in a process of supplying cold air, causing loss of cold air.

SUMMARY

In accordance with an aspect of the disclosure, a refrigerator includes a body including an inner case, the inner case comprising a first storage compartment formed therein, a second storage compartment formed therein and below the first storage compartment, and a third storage compartment provided below the second storage compartment, a first partition arranged between the second storage compartment and the third storage compartment, a second partition arranged between the first storage compartment and the second storage compartment, a cold air supplier arranged in the third storage compartment so as to generate cold air, a first communication hole formed on one surface of the inner case forming the third storage compartment, a second communication hole formed on one surface of the inner case forming the second storage compartment to face the first communication hole, a first guide duct formed in the first partition to guide cold air generated by the cold air supplier from the first communication hole to the second communication hole, and a second guide duct formed in the second partition to guide the cold air which has flown to the first guide duct, to the second storage compartment, the second guide duct connected to the first guide duct through the second communication hole.

The first guide duct may include a first flow space formed in front of a rear surface of the inner case and to allow the generated cold air to flow therethrough.

The inner case may include a first inner case including the first storage compartment and the second storage compartment respectively formed therein, and a second inner case arranged below the first inner case and including the third storage compartment formed therein. The first guide duct may be arranged between the first inner case and the second inner case.

The inner case may include a first communication hole formed in a portion of the second inner case which has been cut out, and to allow the first guide duct to communicate with the third storage compartment, and a second communication hole formed in a portion of the first inner case which has been cut out, and to allow the first guide duct to communicate with the second guide duct.

The cold air supplier may be arranged at a rear of the third storage compartment and to supply cold air to the first guide duct through the first communication hole.

The first communication hole may be formed on an upper surface of the second inner case and the second communication hole may be formed on a lower surface of the first inner case.

The second guide duct may extend downward toward the first guide duct so as to communicate with the second communication hole and the second guide duct includes a second flow space formed therein and through which the cold air passing through the second communication hole flows to the second storage compartment.

The first partition may further include an insulating body arranged in front of the first guide duct to allow the first guide duct to be coupled thereto, the insulating body forming a first flow space formed therein and through which cold air flows together with the first guide duct.

The first guide duct may include a base, and a flow path forming member extending from the base to the insulating body and to form the first flow space therein.

The first guide duct may include a first cold air inlet through which the generated cold air is introduced from the cold air supplier, and a first cold air outlet formed above the first cold air inlet to allow the cold air which is introduced to the first cold air inlet, to flow to the second guide duct, the first cold air outlet arranged to be inclined with respect to the first cold air inlet.

The refrigerator may further include an outer case arranged on an outside of the inner case. The first partition may be arranged between the inner case and the outer case and the second partition may be arranged inside the inner case.

The refrigerator may further include a temperature sensor mounted to a lower surface of the second partition to detect a temperature of the second storage compartment. The second partition may include a cutout portion which has been cut out to allow a wire, which is connected to the temperature sensor, to pass therethrough and to be guided to a rear side of the first storage compartment, and a wire receiving member formed on an upper surface of the second partition to receive the wire passing through the cutout portion.

The second partition may further include a water tank mounting member formed on the upper surface of the second partition to allow a water tank to be mounted thereon, the water tank mounting member arranged in front of the wire receiving member.

The cold air supplier may include a damper mounted to an inside thereof to block a flow of the cold air toward the first guide duct.

The cold air supplier, the first guide duct and the second guide duct may be arranged side by side in a vertical direction.

In accordance with another aspect of the disclosure, a refrigerator comprises an inner case including a first inner case and a second inner case, the first inner case including a first storage compartment formed therein, the second inner case including a second storage compartment formed therein and below the first storage compartment, and the second inner case further including a third storage compartment formed therein and below the second storage compartment, a first partition arranged between the first inner case and the second inner case, a second partition arranged inside the first inner case, and to define the first storage compartment and the second storage compartment, a cold air supplier mounted on the third storage compartment to generate cold air, and to communicate with the first partition, a first guide duct formed in the first partition and including a first flow space formed therein and through which the cold air generated by the cold air supplier, flows, and a second guide duct formed in the second partition to communicate with the first guide duct, and including a second flow space formed therein and through which the cold air guided along the first flow space, flows.

The second guide duct may extend downward toward the first guide duct at a rear of the second storage compartment, and the cold air guided to the second flow space may be discharged to the second storage compartment.

The second inner case may include a first communication hole formed on an upper surface thereof to connect the cold air supplier to the first guide duct, and the first inner case may include a second communication hole formed on a lower surface thereof to connect the first guide duct to the second guide duct.

In accordance with another aspect of the disclosure, a refrigerator includes an inner case having a first storage compartment formed therein, a second storage compartment formed therein and below the first storage compartment, and a third storage compartment formed therein and below the second storage compartment, a cold air supplier mounted on the third storage compartment, a first partition arranged outside the inner case and between the second storage compartment and the third storage compartment, and the first partition including a first guide duct to communicate with the cold air supplier to allow the cold air generated by the cold air supplier, to flow therethrough, and a second partition mounted on an inside of the inner case to define the first storage compartment and the second storage compartment, the second partition including a second guide duct having one end thereof communicates with the first guide duct and an other end thereof communicates with the second storage compartment.

The inner case may include a first communication hole formed therein and to connect the cold air supplier to the first guide duct and formed in front of a rear surface of the inner case, and a second communication hole formed therein and to connect the first guide duct to the second guide duct and formed in front of the rear surface of the inner case.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
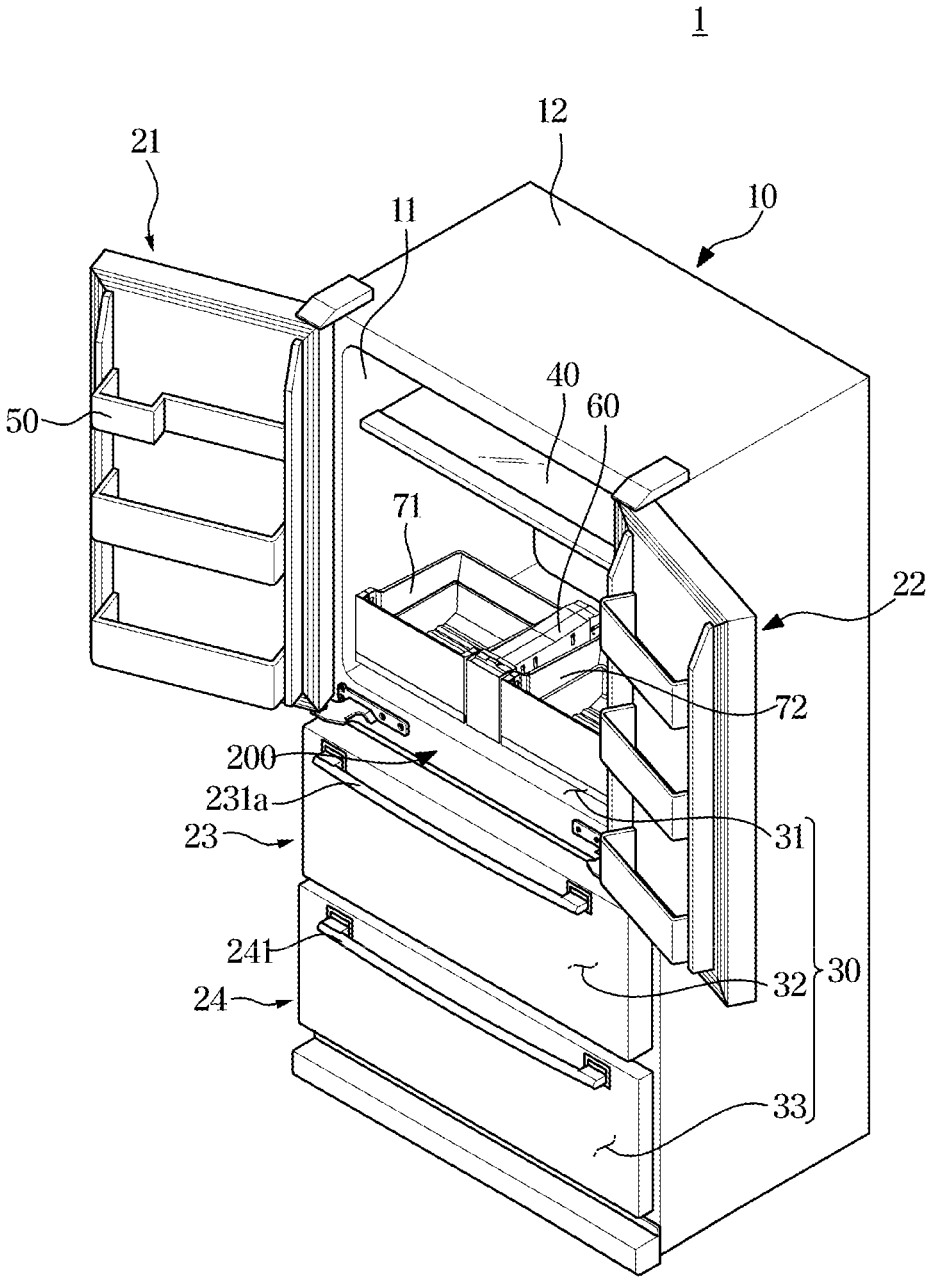
FIG. 1 is a perspective view of a refrigerator according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

The disclosure will be described more fully hereinafter with reference to the accompanying drawings.

An aspect of the disclosure to provide a refrigerator capable of including an improved cold air supply structure to more efficiently supply cold air, which is generated by a cold air supplier, to a storage compartment.

Additional aspects of the disclosure will be set forth in part in the description which follows and, in part, will be obvious from the description, or may be learned by practice of the disclosure.

Figure 2:
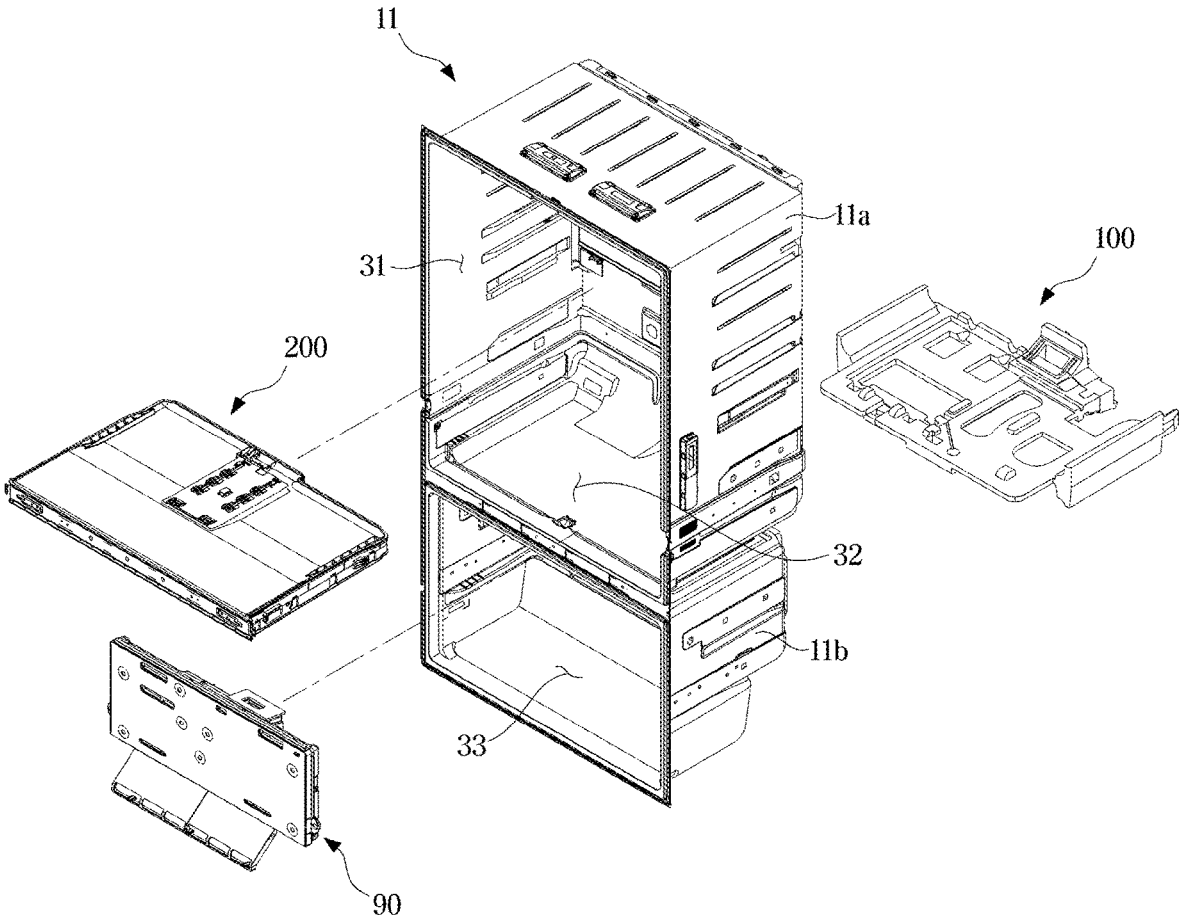
FIG. 2 is a view of a main configuration related to a cold air supply structure of the refrigerator according to an embodiment of the disclosure.
Figure 3:
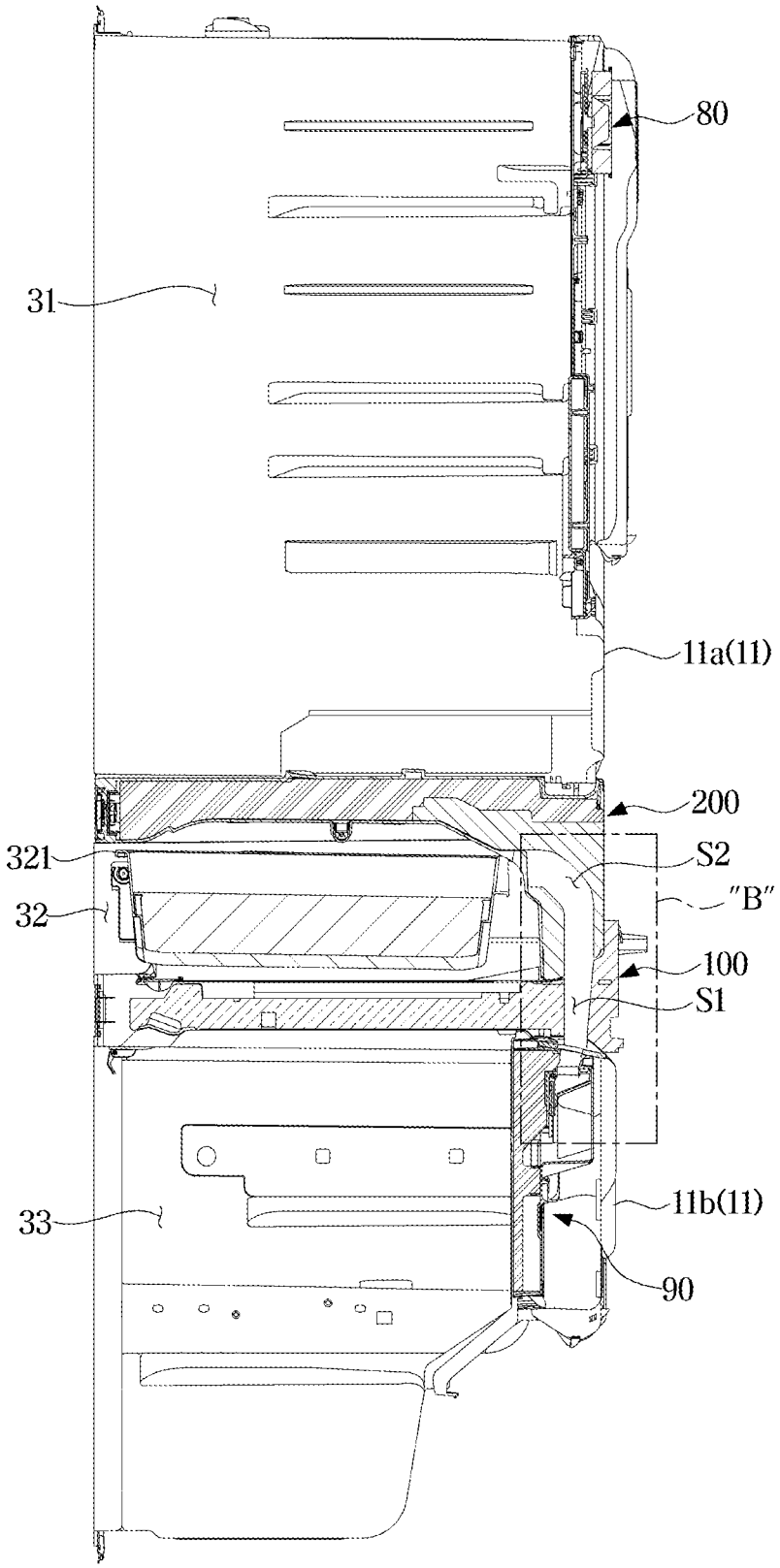
FIG. 3 is a schematic cross-sectional view of the refrigerator shown in FIG. 1.

FIG. 1 is a perspective view of a refrigerator according to an embodiment of the disclosure. FIG. 2 is a view of a main configuration related to a cold air supply structure of the refrigerator according to an embodiment of the disclosure. FIG. 3 is a schematic cross-sectional view of the refrigerator shown in FIG. 1.

A refrigerator may be classified according to a shape of a storage compartment and a door, and thus the refrigerator may be classified into a top mounted freezer (TMF) type in which a storage compartment is divided up and down by a horizontal partition to form a freezing compartment on the upper side and a refrigerating compartment on the lower side, and a bottom mounted freezer (BMF) type refrigerator in which a refrigerating compartment is formed on the upper side and a freezing compartment is formed on the lower side.

Further, the refrigerator may include a side by side (SBS) type refrigerator in which a storage compartment is partitioned left and right by a vertical partition, and a freezing compartment is formed on one side, and a refrigerating compartment is formed on the other side, and a French door refrigerator (FDR) in which a storage compartment is divided up and down by a horizontal partition, a refrigerating compartment is formed on the upper side, a freezing compartment is formed on the lower side, and the refrigerating compartment on the upper side is opened and closed by a pair of doors.

In an embodiment of the disclosure, an FDR-type refrigerator will be described for convenience of description, but the disclosure is not limited thereto.

As illustrated in FIGS. 1 to 3, a refrigerator 1 may include a body 10.

The body 10 may include an inner case 11. The inner case 11 may include a first inner case 11*a* and a second inner case 11*b*.

The first inner case 11*a* may be provided in an upper portion of the inner case 11, and the second inner case 11*b* may be provided in a lower portion of the inner case 11.

The first inner case 11*a* may form a first storage compartment 31 and a second storage compartment 32. The second inner case 11*b* may form a third storage compartment 33. The first inner case 11*a* and the second inner case 11*b* may be formed to be separated from each other.

The body 10 may include an outer case 12 arranged on an outside of the inner case 11. The outer case 12 may form an exterior of the refrigerator 1.

Between the inner case 11 and the outer case 12 of the body 10, a heat insulating material (not shown) may be foamed to prevent cold air from leaking out of the storage compartment 30.

The refrigerator 1 may include a plurality of storage compartments 30 provided inside the body 10 such that a front surface thereof is opened.

The plurality of storage compartments 30 may include the first storage compartment 31, the second storage compartment 32, and the third storage compartment 33.

The first storage compartment 31 may be provided in an upper portion of the refrigerator 1. The first storage compartment 31 may be provided as a refrigerating compartment.

The second storage compartment 32 may be provided below the first storage compartment 31. The second storage compartment 32 may be provided as a variable temperature compartment.

The third storage compartment 33 may be provided under the second storage compartment 32. The third storage compartment 33 may be provided as a freezing compartment.

The refrigerator 1 may include a plurality of doors 21, 22, 23, and 24 configured to open and close the opened front surfaces of the plurality of storage compartments 30.

The plurality of doors 21, 22, 23, and 24 may include a first door 21, a second door 22, a third door 23, and a fourth door 24.

The first door 21 and the second door 22 may be configured to open and close the first storage compartment 31. The first door 21 and the second door 22 may be provided as a side-by-side doors that are rotatably coupled to the body 10. A plurality of door guards 50 provided to receive food and the like may be installed on rear surfaces of the first door 21 and the second door 22.

The first door 21 may open and close a left portion of the open front surface of the first storage compartment 31, and the second door 22 may open and close a right portion of the open front surface of the first storage compartment 31. A gasket (not shown) may be provided on a rear edge of the first door 21 and the second door 22 to seal a gap between the first door 21 and the body 10 and between the second door 22 and the body 10 upon closing the first door 21 and the second door 22.

The third door 23 may be provided to open and close the second storage compartment 32. The third door 23 may be provided as a drawer-type door that is drawn in and out in a sliding manner.

The third door 23 may include a first handle 231*a* arranged on a front surface of the third door 23 to allow a user to grip thereon. A basket 321 provided to store items may be provided in the third storage compartment 33 to be drawn in and out together with the third door 23.

The fourth door 24 may be configured to open and close the third storage compartment 33. The fourth door 24 may be provided as a drawer-type door that is drawn in and out in a sliding manner.

The fourth door 24 may include a second handle 241 arranged on a front surface of the fourth door 24 to allow a user to grip thereon.

The third door 23 and the fourth door 24 may be moved in a front and rear direction in a sliding manner by a guide rail (not shown).

However, the opening/closing method of the first door 21 to the fourth door 24 is not limited to the above-described example and thus the opening/closing method may be modified.

The refrigerator 1 may include a first cold air supplier 90 and a second cold air supplier 80.

The first cold air supplier 90 and the second cold air supplier 80 may include a compressor (not shown), a condenser (not shown), an expansion valve (not shown), an evaporator (not shown), and the like.

A machine room (not shown), in which the compressor (not shown) configured to compress a refrigerant and the condenser (not shown) configured to condense the compressed refrigerant are installed, may be arranged in a rear lower portion of the body 10.

The first cold air supplier 90 may be arranged at a rear of the third storage compartment 33. The second cold air supplier 80 may be arranged at a rear of the first storage compartment 31.

The first cold air supplier 90 may be configured to generate cold air and supply the cold air to the third storage compartment 33. As will be described later, the first cold air supplier 90 may be configured to selectively supply cold air to the second storage compartment 32.

The second cold air supplier 80 may be configured to generate cold air and supply the cold air to the first storage compartment 31.

The refrigerator 1 may include a shelf 40 arranged inside the first storage compartment 31. Items requiring refrigeration may be placed on the shelf 40. The shelf 40 may be provided in plurality.

The refrigerator 1 may include a first drawer 71, a second drawer 72, and a water tank 60.

The first drawer 71 and the second drawer 72 may form an accommodation space to allow fresh food to be stored therein. Further, the first drawer 71 and the second drawer 72 may be provided to be slidably withdrawable toward the front of the first storage compartment 31.

The water tank 60 may be arranged between the first drawer 71 and the second drawer 72 to filter water supplied from a water supply source.

Although not shown, the shelf 40 may be arranged above the first drawer 71, the second drawer 72, and the water tank 60, thereby covering an upper portion of the first drawer 71, the second drawer 72, and the water tank 60.

Referring to FIGS. 2 and 3, the refrigerator 1 may include a first partition 100 and a second partition 200.

The first partition 100 may be arranged between the second storage compartment 32 and the third storage compartment 33. The second partition 200 may be provided to define the first storage compartment 31 and the second storage compartment 32.

In addition, the first partition 100 may be arranged between the first inner case 11*a* and the second inner case 11*b*. The first partition 100 may be formed of a kind of heat insulating material, such as Expanded PolyStyrene (EPS) that is lightweight and has a superior thermal insulation performance. However, the disclosure is not limited thereto, and a portion of the first partition 100 may be formed of an EPS material to insulate between the second storage compartment 32 and the third storage compartment 33, and other portion of the first partition 100 may be provided with an injection molded product formed of a plastic material to form a first flow space S1.

The second partition 200 may be arranged between the first storage compartment 31 and the second storage compartment 32 such that an upper surface of the second partition 200 faces the first storage compartment 31 and a lower surface of the second partition 200 faces the second storage compartment 32. A portion of the second partition 200 may be formed of an EPS material to insulate between the first storage compartment 31 and the second storage compartment 32, and other portion of the second partition 200 may be provided with an injection molded product formed of a plastic material to form a second flow space S2. However, the disclosure is not limited thereto, and the second partition 200 may be entirely formed of an EPS material.

The first cold air supplier 90 may be arranged at the rear of the third storage compartment 33 to be connected to the first partition 100. Particularly, cold air generated by the first cold air supplier 90 may be supplied to the third storage compartment 33, but may be supplied to the second storage compartment 32 through the first flow space S1 of the first partition 100 and the second flow space S2 of the second partition 200. Details related to this will be described later.

Figure 4:
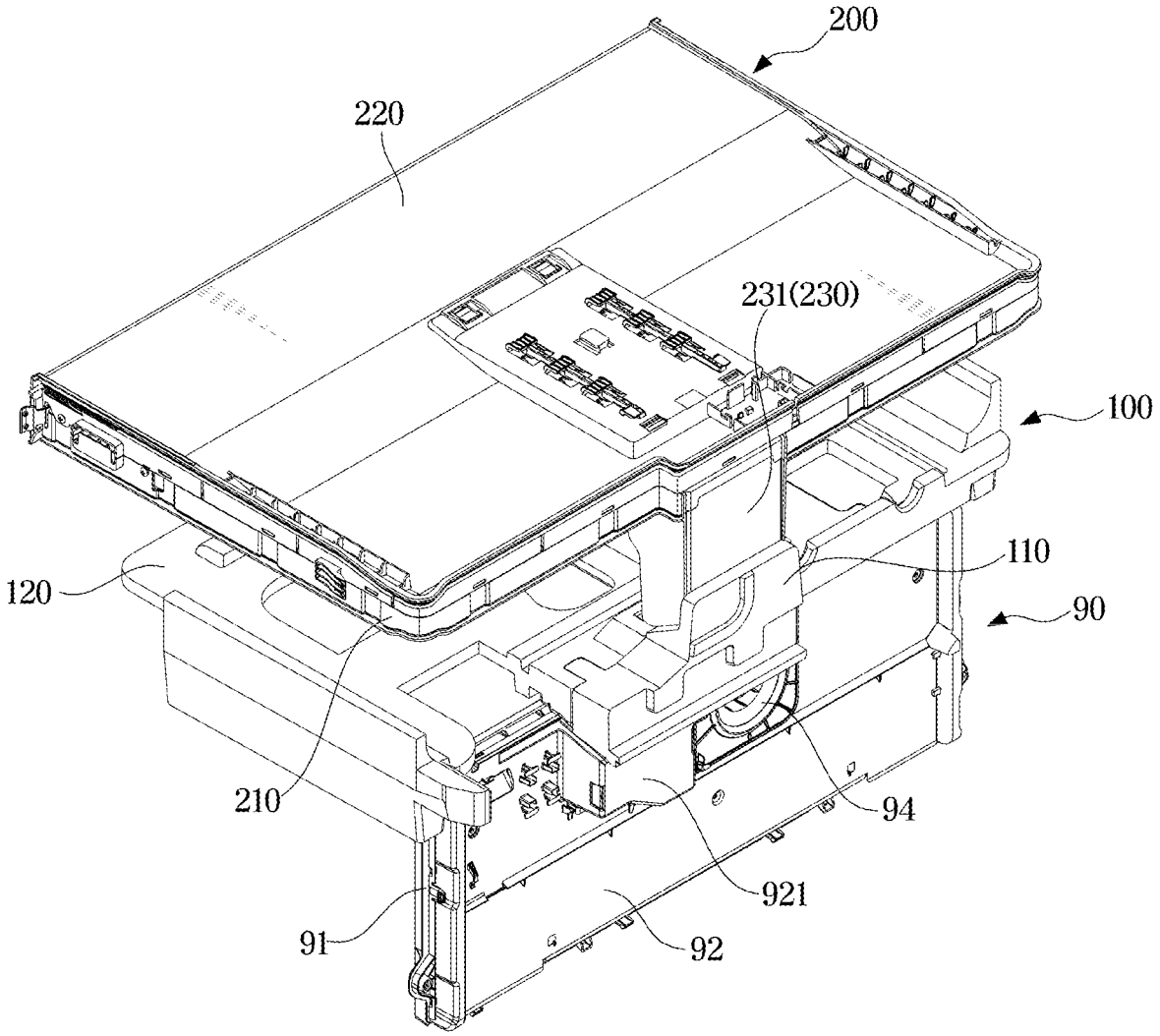
FIG. 4 is a rear-perspective view illustrating a state in which a cold air supplier, a first partition, and a second partition of the refrigerator according to an embodiment of the disclosure are coupled to each other.

FIG. 4 is a rear-perspective view illustrating a state in which a cold air supplier, a first partition, and a second partition of the refrigerator according to an embodiment of the disclosure are coupled to each other.

A cold air supply structure of the second storage compartment 32 of the refrigerator 1 according to an embodiment of the disclosure will be briefly described with reference to FIG. 4.

The first cold air supplier 90 may be configured to generate cold air. The first cold air supplier 90 may be connected to the first partition 100. The first partition 100 may be arranged above the first cold air supplier 90. Particularly, the cold air generated by the first cold air supplier 90 may flow to a first guide duct 110 of the first partition 100.

The cold air flowing to the first guide duct 110 of the first partition 100 may flow to a second guide duct 231 of the second partition 200. The second partition 200 may be arranged above the first partition 100. The cold air flowing to the second guide duct 231 may be discharged between the first partition 100 and the second partition 200 and flow into the second storage compartment 32. At this time, the flow of the cold air may be substantially performed above the first cold air supplier 90, and a cold air supply structure may be formed to prevent the cold air from bypassing to the rear of the first cold air supplier 90.

Hereinafter detailed structures of the first cold air supplier 90, the first partition 100, and the second partition 200 that are provided to supply cold air to the second storage compartment 32 will be described.

Figure 5:
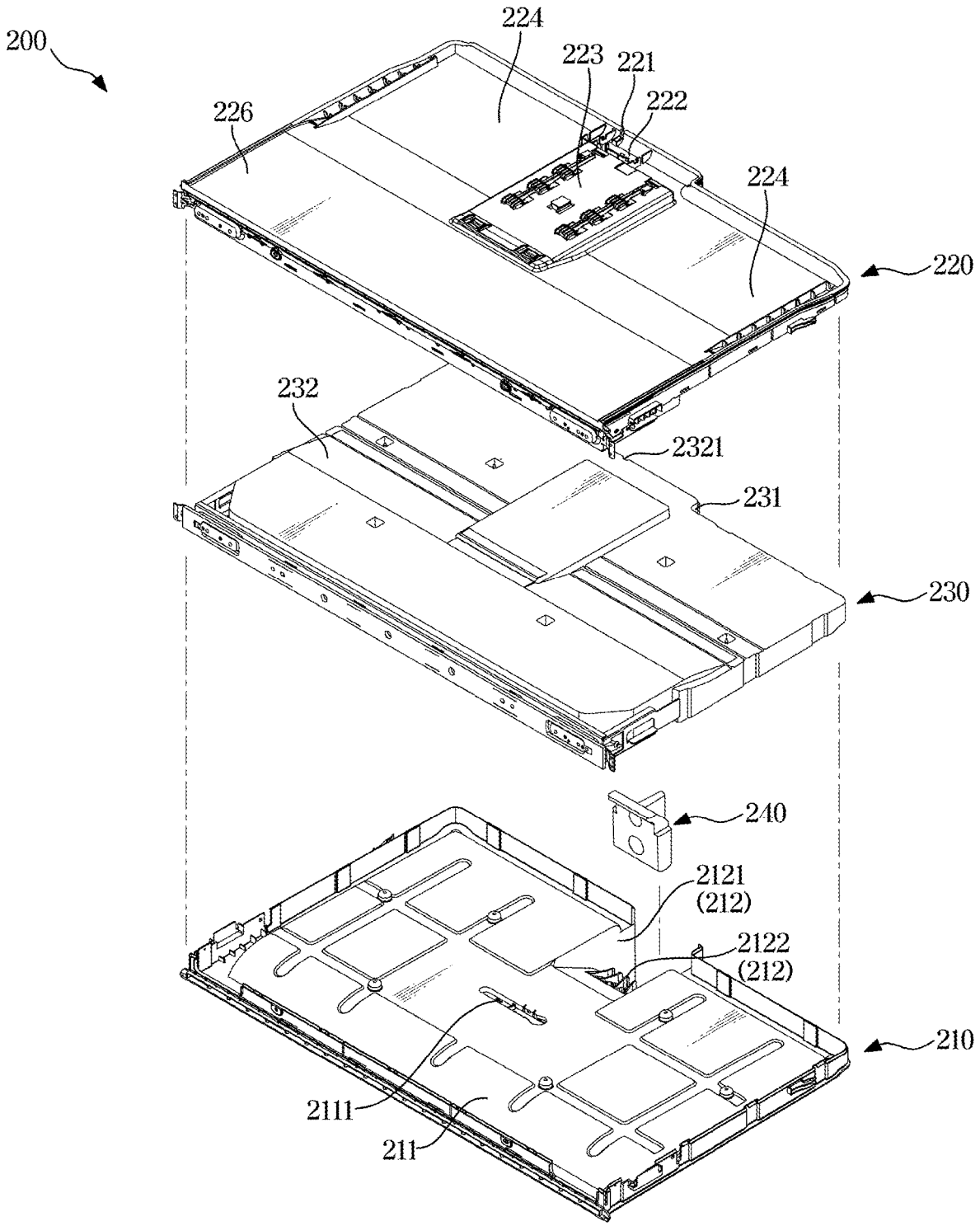
FIG. 5 is an exploded view of the second partition shown in FIG. 4 when viewed from the front.
Figure 6:
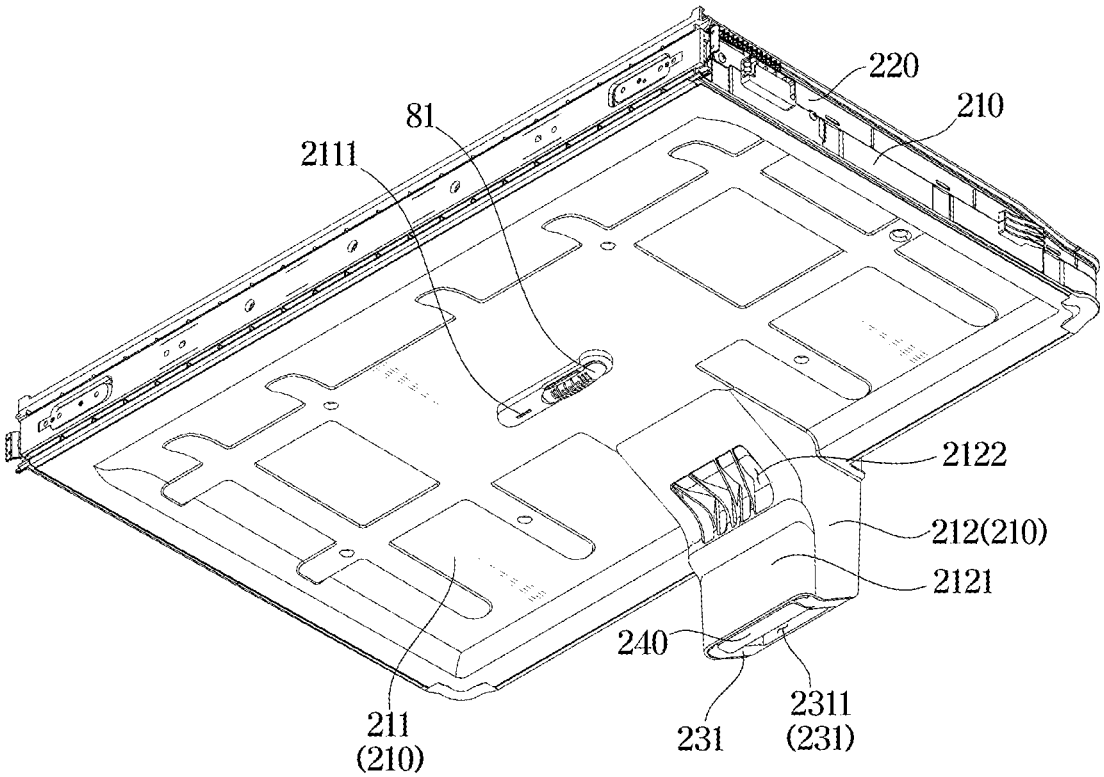
FIG. 6 is a bottom perspective view of the second partition shown in FIG. 5.

FIG. 5 is an exploded view of the second partition shown in FIG. 4 when viewed from the front. FIG. 6 is a bottom perspective view of the second partition shown in FIG. 5.

As illustrated in FIGS. 5 and 6, the second partition 200 may include a first housing 210, a second housing 220, and a third housing 230.

The first housing 210 and the second housing 220 may be vertically coupled such that the third housing 230 is arranged therebetween.

The first housing 210 may include a lower body 211 and an extension housing 212.

The lower body 211 may form a lower surface of the second partition 200 and form a portion of a side surface of the second partition 200.

The extension housing 212 may extend downward from the lower body 211. Particularly, the extension housing 212 may extend downward from the rear of the lower body 211.

The extension housing 212 may include a duct cover 2121 and a second cold air outlet 2122.

The duct cover 2121 may be provided to cover the second guide duct 231, which will be described later, from the outside. The second cold air outlet 2122 may be formed toward the second storage compartment 32 to allow the second storage compartment 32 to communicate with the second guide duct 231 to be described later. That is, the second cold air outlet 2122 may be provided to allow cold air, which flows to the second guide duct 231, to be discharged to the second storage compartment 32.

The lower body 211 may include a sensor receiving member 2111. A temperature sensor 81 may be received in the sensor receiving member 2111 to detect a temperature of the second storage compartment 32.

The sensor receiving member 2111 may be recessed toward the lower body 211 to form a space in which the temperature sensor 81 is received. In addition, a portion of the sensor receiving member 2111 may be cut to allow the temperature sensor 81 to be exposed to the second storage compartment 32.

Accordingly, the temperature sensor 81 may be mounted on the lower surface of the second partition 200.

The second housing 220 may include an upper body 226.

The upper body 226 may form the upper surface of the second partition 200 and form a portion of a side surface of the second partition 200.

The upper body 226 may be arranged to face the first storage compartment 31. The upper body 226 may include a water tank mounting member 223 and a drawer mounting member 224.

The drawer mounting member 224 may be provided to mount the first drawer 71 and the second drawer 72 arranged in the first storage compartment 31. The drawer mounting member 224 may be partially inclined toward the rear of the upper body 226. Accordingly, it is possible to prevent the first drawer 71 and the second drawer 72 from being drawn out to the front of the first storage compartment 31 in an unexpected situation.

The water tank mounting member 223 may be formed between the drawer mounting members 224. The water tank 60 may be mounted on the water tank mounting member 223. The water tank mounting member 223 may be formed approximately in the center of the upper surface of the second partition 200.

The upper body 226 may include a cutout 221 and a wire receiving member 222.

The cutout 221 may be formed by cutting a portion of the upper body 226 to allow a wire, which is connected to the temperature sensor 81, to extend toward an inner side of the first housing 210 and to pass through the cutout 221 and then to be guided to the rear of the first storage compartment 31.

Particularly, the cutout 221 may be formed by cutting a portion of a side surface and an upper surface of the upper body 226.

The wire receiving member 222 may be formed to allow the wire passing through the cutout 221 to be received in the upper body 226. Details related to the cutout 221 and the wire receiving member 222 will be described later.

The second partition 200 may include the third housing 230. The third housing 230 may be arranged between the first housing 210 and the second housing 220 to serve as a kind of an insulating material. Accordingly, the third housing 230 may be formed of an EPS material. However, the disclosure is not limited thereto, and a portion of the third housing 230 may be formed of an EPS material and other portion of the third housing 230 may be provided with an injection molded product formed of a plastic material.

The third housing 230 may include a middle body 232 and the second guide duct 231.

The middle body 232 may be received between the first housing 210 and the second housing 220 to insulate the first storage compartment 31 and the second storage compartment 32, respectively. Particularly, the middle body 232 may be arranged between the lower body 211 of the first housing 210 and the upper body 226 of the second housing 220.

A recess 2321 may be formed at a rear of the middle body 232 to allow the wire connected to the temperature sensor 81 to be guided to the cutout 221 of the second housing 220.

The second guide duct 231 may extend downward from the rear of the middle body 232.

The second guide duct 231 may include a second cold air inlet 2311, to be described later, through which cold air is introduced from the first guide duct 110. The second guide duct 231 may be arranged inside the extension housing 212.

Therefore, the cold air introduced into the second cold air inlet 2311 may flow through the second guide duct 231 and be discharged to the second storage compartment 32 through the second cold air outlet 2122 of the extension housing 212.

However, the disclosure is not limited thereto, and the second guide duct 231 and the extension housing 212 may be integrally formed with each other.

The second partition 200 may include a divider 240. The divider 240 may be arranged between the second guide duct 231 and the extension housing 212 to allow cold air, which introduced into the second cold air inlet 2311, to uniformly flow in a left and right direction.

Figure 7:
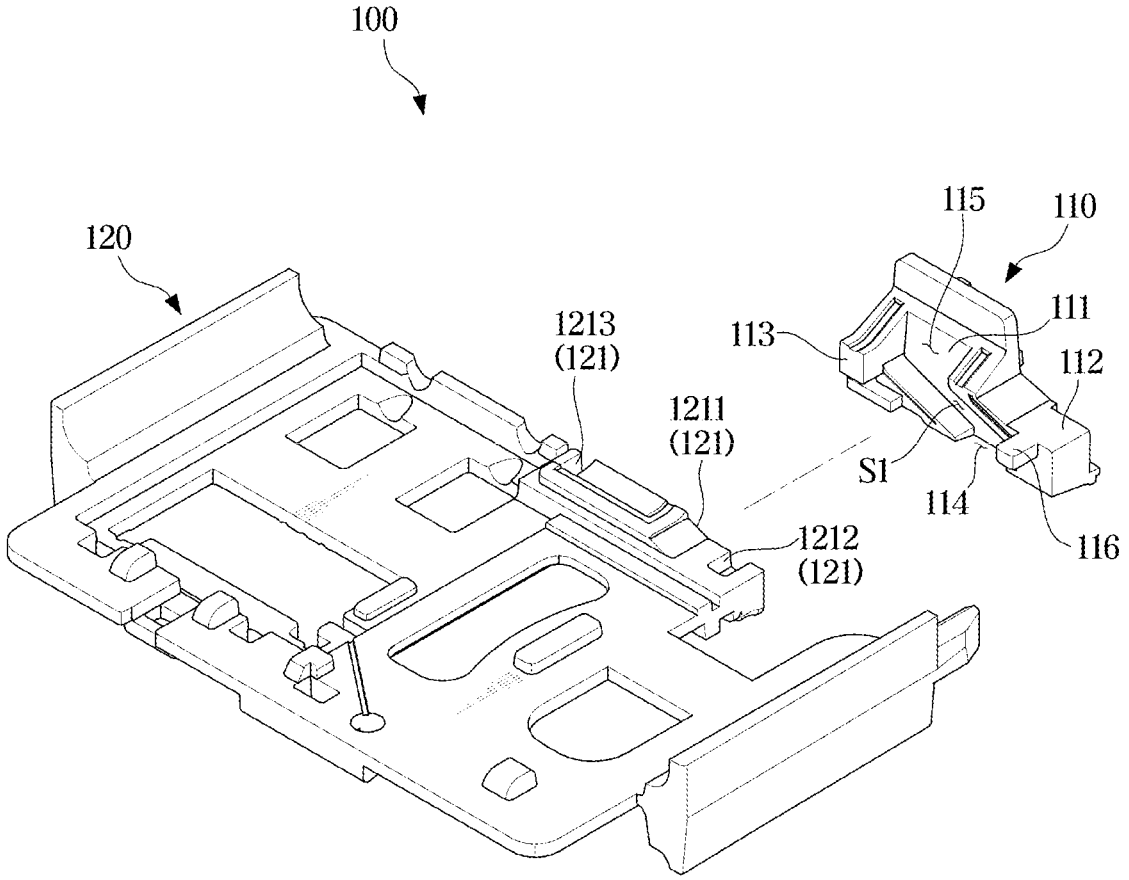
FIG. 7 is an exploded view of the first partition shown in FIG. 4 when viewed from the front.
Figure 8:
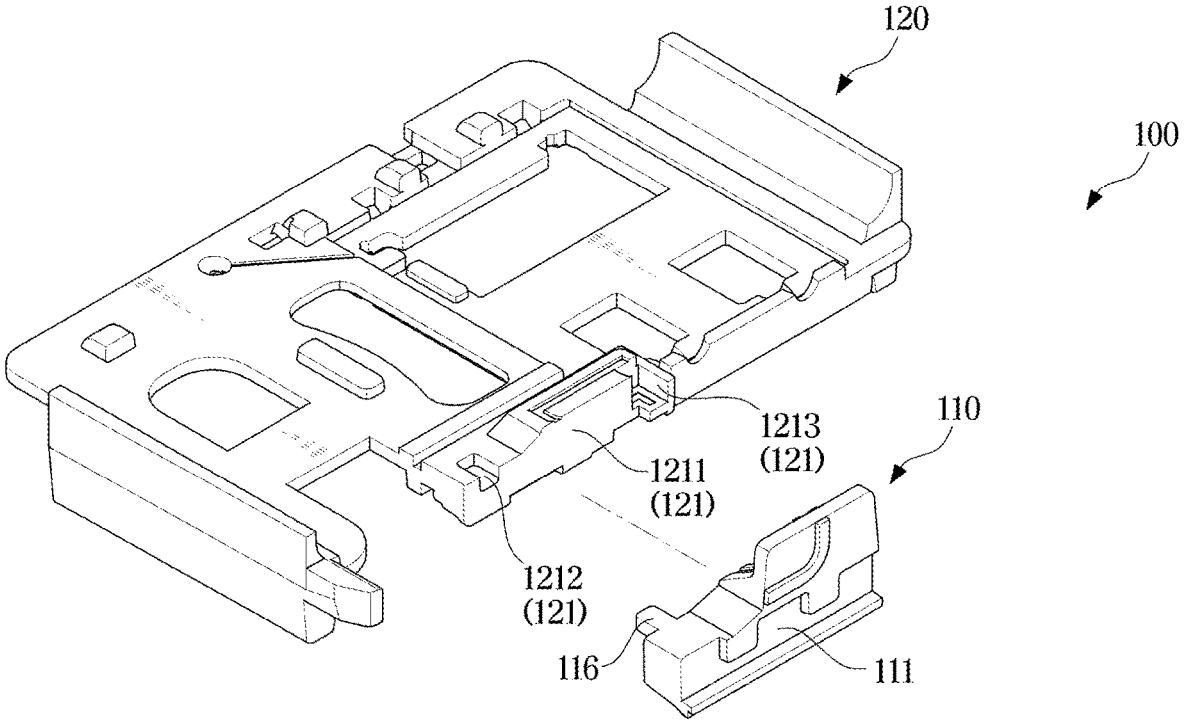
FIG. 8 is a rear view of the first partition shown in FIG. 7.

FIG. 7 is an exploded view of the first partition shown in FIG. 4 when viewed from the front. FIG. 8 is a rear view of the first partition shown in FIG. 7.

Referring to FIGS. 7 and 8, the first partition 100 may include an insulating body 120 and the first guide duct 110.

The insulating body 120 may be arranged in front of the first guide duct 110 to allow the first guide duct 110 to be coupled thereto. The insulating body 120 may form the first flow space S1, through which cold air flows, together with the first guide duct 110.

Particularly, the insulating body 120 may include a duct mounting member 121. The first guide duct 110 may be detachably coupled to the duct mounting member 121. The duct mounting member 121 may be formed on one rear side of the insulating body 120.

The duct mounting member 121 may include a cover flange 1211.

The cover flange 1211 may be provided to face the first guide duct 110 to form the first flow space S1 together with the first guide duct 110.

The duct mounting member 121 may include a protrusion receiving groove 1212 and a duct mounting groove 1213.

The protrusion receiving groove 1212 may be formed on one side of the cover flange 1211, and the duct mounting groove 1213 may be formed on the other side of the cover flange 1211. Particularly, the protrusion receiving groove 1212 and the duct mounting groove 1213 may be formed by being recessed toward the insulating body 120.

The protrusion receiving groove 1212 may be provided to receive a coupling protrusion 116 of the first guide duct 110 to be described later. The duct mounting groove 1213 may be provided to receive a body mounting member 113 of the first guide duct 110 to be described later.

The first guide duct 110 may include a base 111 and a flow path forming member 112.

The flow path forming member 112 may extend from the base 111 toward the insulating body 120 to form the first flow space S1 therein.

The first guide duct 110 may include the coupling protrusion 116 and the body mounting member 113 which extend from the flow path forming member 112 toward the insulating body 120.

The coupling protrusion 116 may be received in the protrusion receiving groove 1212 of the insulating body 120, and the body mounting member 113 may be received in the duct mounting groove 1213 of the insulating body 120. However, the disclosure is not limited thereto, and only one of the coupling protrusion 116 and the body mounting member 113 may be formed. Accordingly, the first guide duct 110 may be fitted to the insulating body 120.

The first guide duct 110 may include a first cold air inlet 114 and a first cold air outlet 115.

The first cold air inlet 114 may be provided to allow cold air to be introduced from the cold air supplier.

The first cold air outlet 115 may be formed above the first cold air inlet 114 to allow the cold air, which is introduced into the first cold air inlet 114, to flow to the second guide duct 231.

The first cold air inlet 114 may be formed at a lower end of the first flow space S1, and the second cold air inlet 2311 may be formed at an upper end of the second flow space S2.

The first guide duct 110 may include the flow path forming member 112 forming the first flow space S1 for guiding the cold air supplied from the first cold air supplier 90 to the second guide duct 231. The flow path forming member 112 may be formed to be inclined from one side of the first guide duct 110 toward the other side. That is, the first flow space S1 may be inclined inside the first guide duct 110. In other words, the first cold air outlet 115 may be tilted based on the vertical direction of the first cold air inlet 114 and the refrigerator 1.

This is related to a structure of the first cold air supplier 90 to be described later, and because a blower fan 94 is arranged on one side of the first cold air supplier 90, air, which is moved to a damper 93 by the blower fan 94, may tend to be tilted to one side by an airflow formed by the blower fan 94.

When cold air flows along the first flow space S1 and to be discharged to the second storage compartment 32 through the second guide duct 231 in a state in which the first flow space S1 of the first guide duct 110 is not formed to be inclined, the airflow may be tilted to one side. Accordingly, it is difficult to uniformly cool the inside of the second storage compartment 32.

Accordingly, the first guide duct 110 of the refrigerator 1 according to an embodiment of the disclosure may be provided with the inclined flow path forming member 112 so as to substantially correct a flow direction of cold air flowing the first flow space S1, thereby uniformly cooling the second storage compartment 32.

However, the shape of the first guide duct 110 is not limited thereto, and the shape of the flow path forming member 112 of the first guide duct 110 may vary depending on the position and type of the blower fan 94. The flow path forming member 112 of the first guide duct 110 may be formed in a straight line along the vertical direction instead of being inclined.

Figure 9:
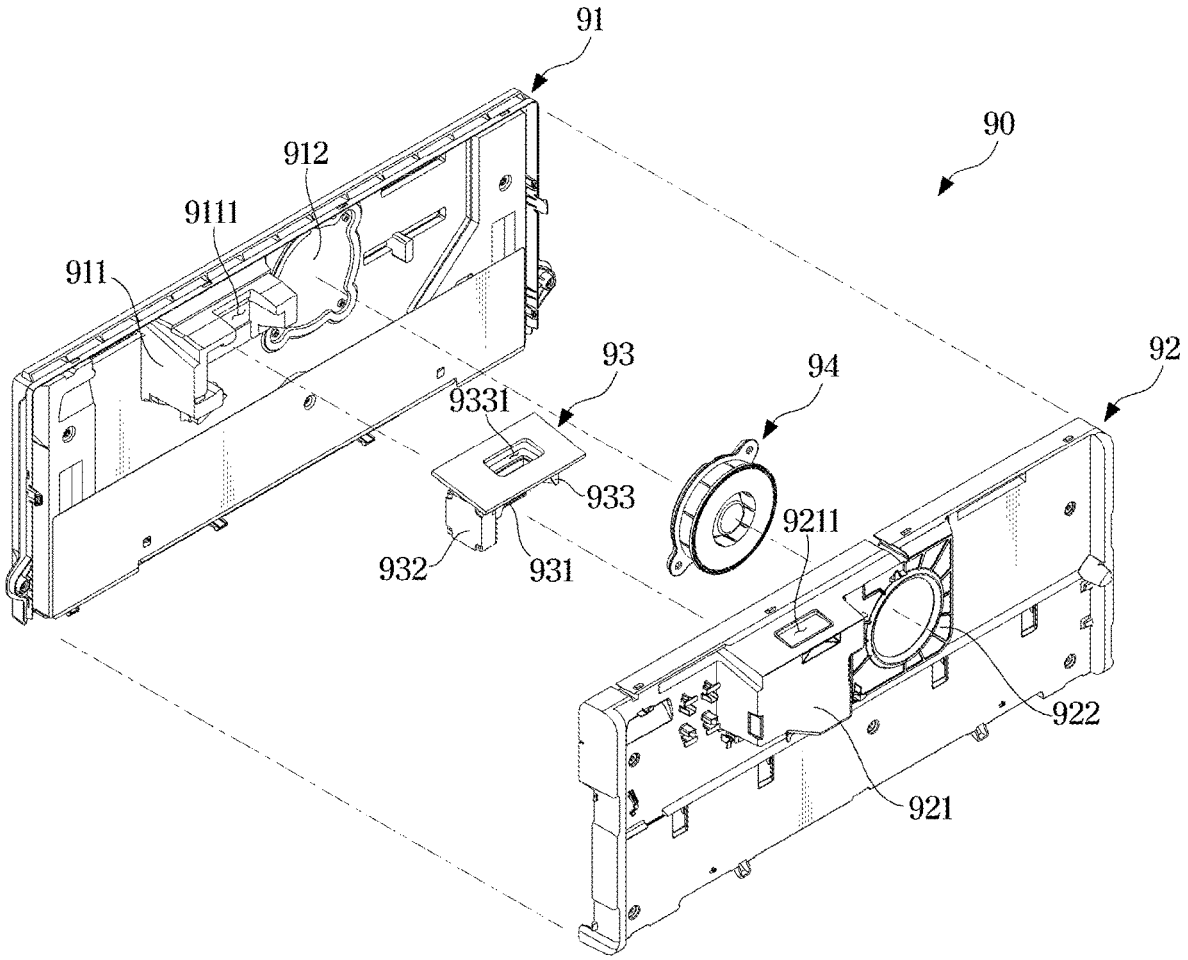
FIG. 9 is an exploded view of the cold air supplier shown in FIG. 4 when viewed from the rear.

FIG. 9 is an exploded view of the cold air supplier shown in FIG. 4 when viewed from the rear.

A detailed structure of the first cold air supplier 90 will be described with reference to FIG. 9.

The first cold air supplier 90 may include a front cover 91 and a rear cover 92.

The front cover 91 corresponding to a configuration exposed to the third storage compartment 33 may include a plurality of cold air supply holes (not shown) to discharge cold air to the third storage compartment 33.

The rear cover 92 may be coupled to the front cover 91 to form a rear surface of the first cold air supplier 90.

The first cold air supplier 90 may include the blower fan 94 and the damper 93 received between the front cover 91 and the rear cover 92.

The blower fan 94 may suck in cold air of the third storage compartment 33 and move the cold air between the front cover 91 and the rear cover 92. The blower fan 94 may be mounted between a fan mounting member 912 of the front cover 91 and a fan cover 922 of the rear cover 92. The blower fan 94 may be provided as a centrifugal fan.

The damper 93 may be mounted between a damper mounting member 911 of the front cover 91 and the damper cover 921 of the rear cover 92.

The damper mounting member 911 of the front cover 91 may extend rearward from a rear surface of the front cover 91 to form a space in which the damper 93 is received. In addition, a first cold air flow hole 9111 may be formed at an upper portion of the damper mounting member 911 to allow cold air to flow.

The damper cover 921 of the rear cover 92 may be formed in a shape corresponding to the damper mounting member 911. The damper cover 921 may be provided to cover the rear of the damper 93 and to cover the upper portion of the damper mounting member 911.

The damper cover 921 may include a second cold air flow hole 9211. The second cold air flow hole 9211 may be formed at a position corresponding to the first cold air flow hole 9111 of the damper mounting member 911 and may be formed above the first cold air flow hole 9111. Accordingly, cold air flowing through the first cold air flow hole 9111 may flow into the second cold air flow hole 9211.

The damper 93 may be provided to block the flow of cold air toward the first guide duct 110. In other words, the damper 93 may be provided to open and close the cold air supply flow path to allow or to prevent the flow of the cold air toward the first guide duct 110.

The damper 93 may include a mounting frame 933, a motor member 932, and an opening and closing member 931.

The mounting frame 933 may be provided to be received and supported by the damper mounting member 911 of the front cover 91. The motor member 932 may be provided on one side of the mounting frame 933 to provide a driving force.

A cold air outlet hole 9331 may be formed on an upper surface of the mounting frame 933. The cold air outlet hole 9331 may be provided to communicate with the first cold air flow hole 9111 of the front cover 91 and the second cold air flow hole 9211 of the rear cover 92.

The opening and closing member 931 may be rotatably provided inside the mounting frame 933. The opening and closing member 931 may be connected to the motor member 932 to open and close the flow path under the control of a controller (not shown).

Particularly, the opening and closing member 931 may open and close the flow path to allow or to prevent the flow of the cold air toward the cold air outlet hole 9331, the first cold air flow hole 9111 and the second cold air flow hole 9211.

However, the position of the damper 93 of the refrigerator 1 according to an embodiment of the disclosure is not limited thereto, and the damper 93 may be arranged in any position in the flow path in which cold air is supplied from the third storage compartment 33 to the second storage compartment 32.

Figure 10:
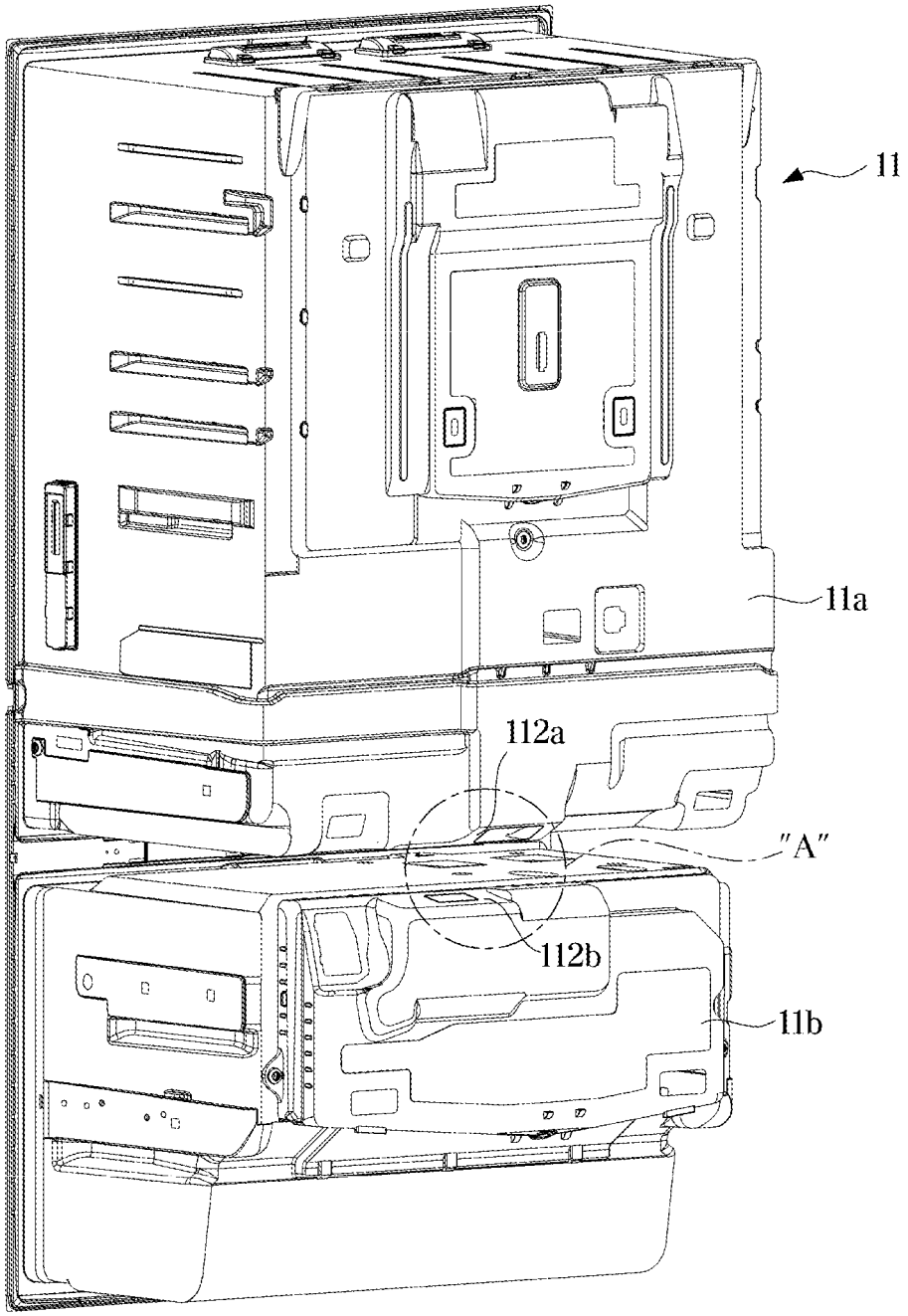
FIG. 10 is a rear view of an inner case of the refrigerator according to an embodiment of the disclosure.
Figure 11:
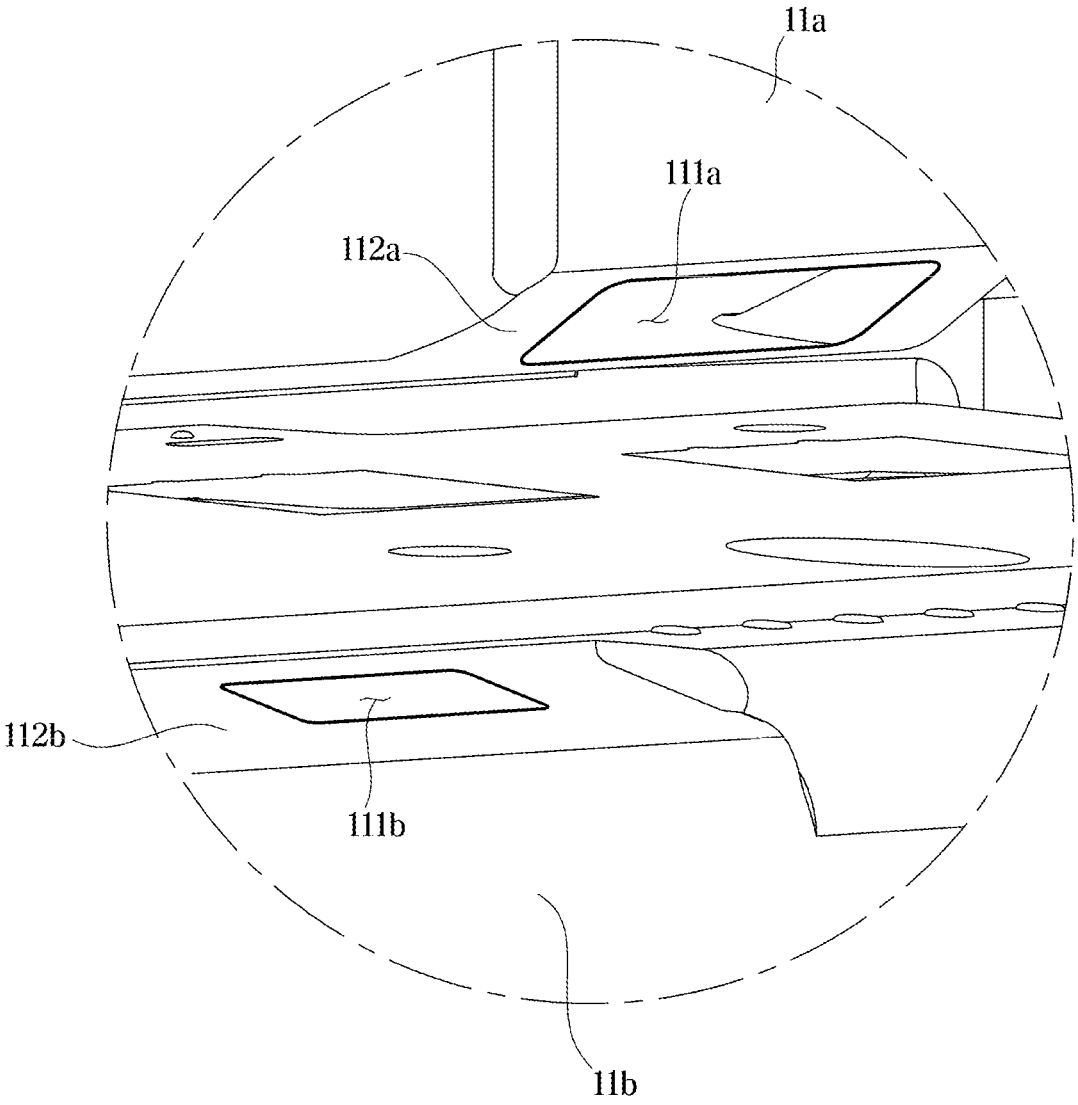
FIG. 11 is an enlarged view of a portion A of FIG. 10.
Figure 12:
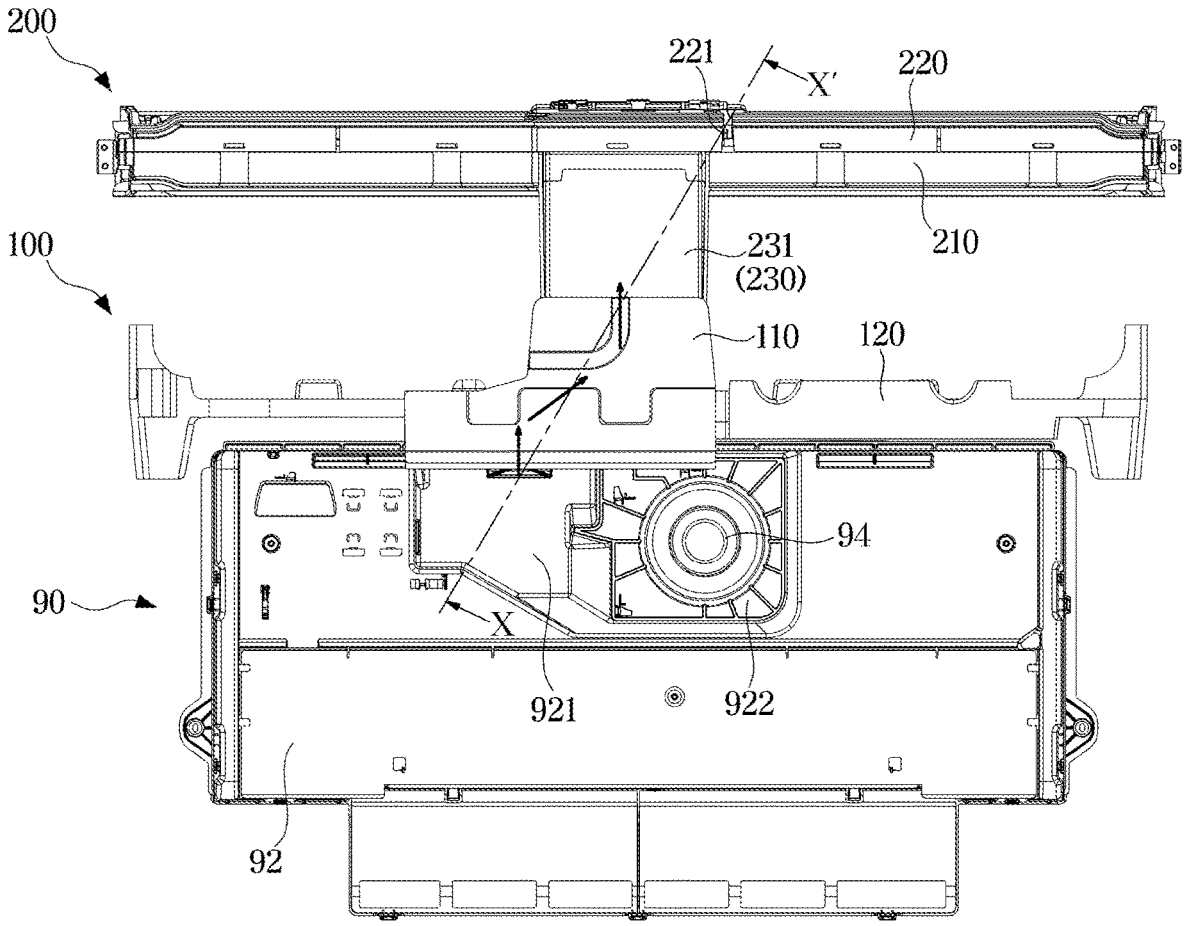
FIG. 12 is a front view illustrating a state in which the cold air supplier, the first partition, and the second partition of the refrigerator according to an embodiment of the disclosure are coupled to each other, when viewed from the rear.
Figure 13:
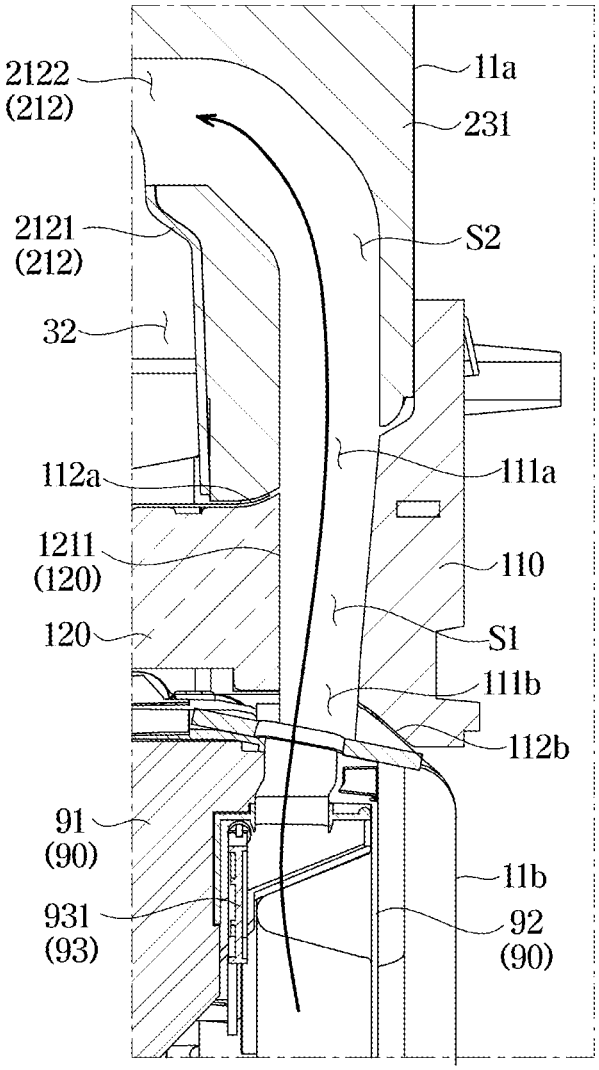
FIG. 13 is a cross-sectional view taken along line X-X' of FIG. 12.

FIG. 10 is a rear view of an inner case of the refrigerator according to an embodiment of the disclosure. FIG. 11 is an enlarged view of a portion A of FIG. 10. FIG. 12 is a front view of a state in which the cold air supplier, the first partition, and the second partition of the refrigerator according to an embodiment of the disclosure are coupled to each other, when viewed from the rear. FIG. 13 is a cross-sectional view taken along line X-X' of FIG. 12.

Referring to FIGS. 10 to 13, the inner case 11 may include a first communication hole 111*b* and a second communication hole 111*a*.

The first communication hole 111*b* may be formed on one surface of the inner case 11 forming the third storage compartment 33.

The second communication hole 111*a* may be formed on one surface of the inner case 11 forming the second storage compartment 32. The second communication hole 111*a* may be formed in the inner case 11 to face the first communication hole 111*b*.

Particularly, the second inner case 11*b* may include the first communication hole 111*b* and the first inner case 11*a* may include the second communication hole 111*a*.

The first communication hole 111*b* and the second communication hole 111*a* may be opened to allow cold air to flow from the first cold air supplier 90 arranged inside the second inner case 11*b* toward the second storage compartment 32 formed inside the first inner case 11*a*.

The first guide duct 110 may be provided to connect the first communication hole 111*b* and the second communication hole 111*a*.

The first guide duct 110 may be formed in the first partition 100 to guide cold air, which is generated by the first cold air supplier 90, from the first communication hole 111*b* to the second communication hole 111*a*.

The second guide duct 231 may be formed in the second partition 200 to guide the cold air, which flows to the first guide duct 110, to the second storage compartment 32. The second guide duct 231 may be connected to the first guide duct 110 through the second communication hole 111*a*.

That is, as the first partition 100 is assembled to be arranged between the first inner case 11*a* and the second inner case 11*b*, the first guide duct 110 may be arranged between the first communication hole 111*b* and the second communication hole 111*a* so as to connect the first communication hole 111*b* and the second communication hole 111*a*.

The first communication hole 111*b* may be formed by cutting the second inner case 11*b*, so as to allow the first guide duct 110 to communicate with the third storage compartment 33. The second communication hole 111*a* may be formed by cutting the first inner case 11*a*, so as to allow the first guide duct 110 to communicate with the second guide duct 231.

Particularly, the first communication hole 111*b* may be formed on the upper surface of the second inner case 11*b*. A second duct mounting member 112*b* may be provided on a rear upper surface of the second inner case 11*b*. The first communication hole 111*b* may be formed in the second duct mounting member 112*b*.

The first guide duct 110 may be mounted on the second duct mounting member 112*b*, and a lower portion of the first guide duct 110 may be supported by the second duct mounting member 112*b*.

Accordingly, the first communication hole 111*b* may communicate with the first cold air inlet 114 of the first guide duct 110.

The second communication hole 111*a* may be formed on a lower surface of the first inner case 11*a*. A first duct mounting member 112*a* may be provided on a rear lower surface of the first inner case 11*a*. The second communication hole 111*a* may be formed in the first duct mounting member 112*a*.

The first guide duct 110 may be mounted on the first duct mounting member 112*a*, and an upper portion of the first guide duct 110 may be supported by the first duct mounting member 112*a*.

Accordingly, the second communication hole 111*a* may communicate with the first cold air outlet 115 of the first guide duct 110.

In addition, the second guide duct 231 may be arranged inside the first inner case 11*a*. The second cold air inlet 2311 formed in the lower portion of the second guide duct 231 may communicate with the second communication hole 111*a*.

The first guide duct 110 corresponding to a configuration arranged at the rear of the first partition 100 may be arranged on the outside of the inner case 11. That is, because the first guide duct 110 is arranged between the first inner case 11*a* and the second inner case 11*b*, the first inner case 11*a* and the second inner case 11*b* may be provided with the first communication hole 111*b* and the second communication hole 111*a*, respectively, for communication with the first guide duct 110 through the cold air flows.

Accordingly, in an open state of the damper 93, the cold air, which is generated by the first cold air supplier 90 and passes through the first communication hole 111*b*, may flow to the first cold air inlet 114 of the first guide duct 110, and flow to the first cold air outlet 115 along the first flow space S1 of the first guide duct 110.

Thereafter, the cold air may pass through the second communication hole 111*a* and be guided to the second flow space S2 through the second cold air inlet 2311 of the second guide duct 231.

Thereafter, the cold air guided to the second flow space S2 may be discharged to the second storage compartment 32 through the second cold air outlet 2122.

The first flow space S1 of the first guide duct 110 of the refrigerator 1 according to an embodiment of the disclosure may be formed in front of the rear surface of the inner case 11.

In addition, the second guide duct 231 extending downward toward the first guide duct 110 may communicate with the second communication hole 111*a*, and may form the second flow space S2 through which the cold air passing through the second communication hole 111*a* flows to the second storage compartment 32. The second flow space S2 may also be formed in front of the rear surface of the inner case 11.

In addition, the first cold air supplier 90, the first guide duct 110, and the second guide duct 231 may be arranged side by side in the vertical direction of the refrigerator 1.

Therefore, in the refrigerator 1 according to an embodiment of the disclosure, the first guide duct 110 may be formed in the first partition 100 and the second guide duct 231 may be formed in the second partition 200. Therefore, it is possible to implement a structure for supplying cold air to the second storage compartment 32 without a separate duct that is bypassed to avoid interference with the first partition 100 and the second partition 200.

Accordingly, the flow path, through which the cold air generated by the first cold air supplier 90 flows to the second storage compartment 32, may be formed relatively shorter, and thus it is possible to minimize the loss of the cold air.

Further, between the first inner case 11*a* and the second inner case 11*b*, the cold air may flow approximately linearly along the vertical direction of the refrigerator 1 without being bypassed in the front and rear direction. Accordingly, it is possible to minimize the loss of the cold air.

Further, because cold air flows through a portion of the first partition 100 without a separate connection duct, the overall structure may be simplified.

Further, because the damper 93 is arranged inside the first cold air supplier 90, it is possible to control whether cold air is discharged or not, on the relatively upstream side of the cold air supply flow path. Accordingly, it is possible to prevent the cold air from stagnating inside the first guide duct 110 and the second guide duct 231.

In addition, because the second guide duct 231 guiding the cold air to the second storage compartment 32 extends to the rear lower side of the second partition 200, it is possible to secure a relatively large size of the first storage compartment 31 formed above the second partition 200.

Figure 14:
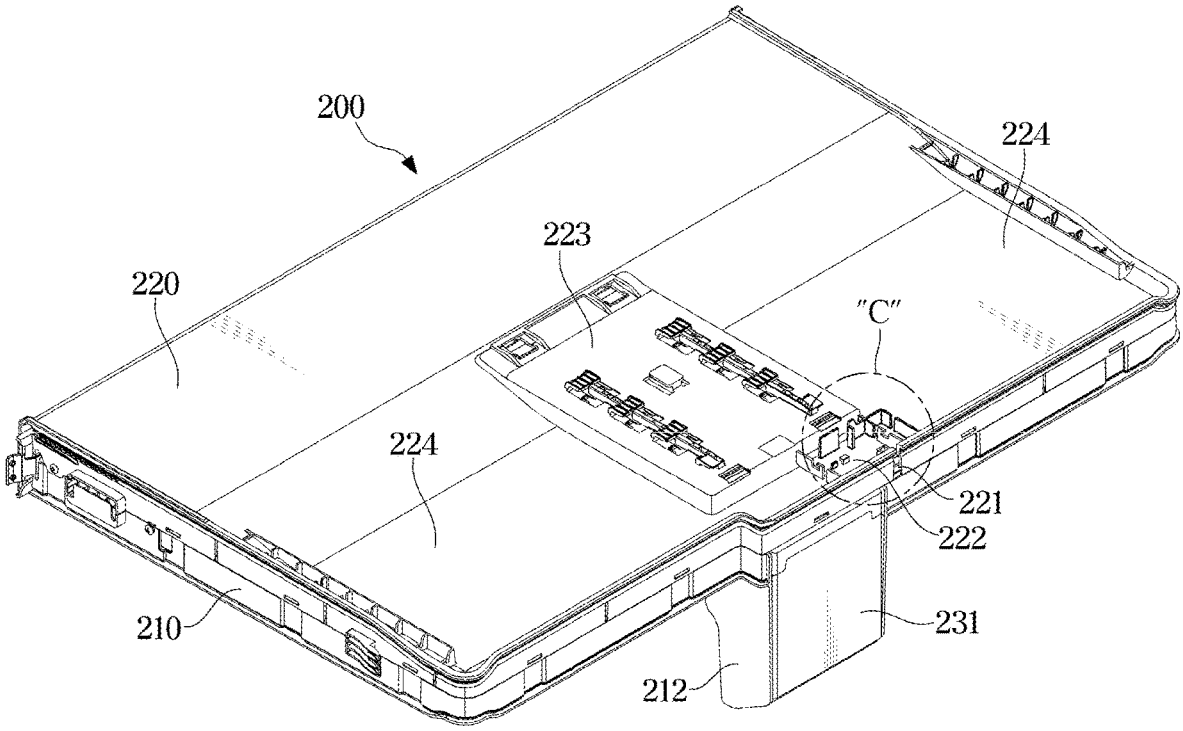
FIG. 14 is a rear-perspective view of the first partition shown in FIG. 4.
Figure 15:
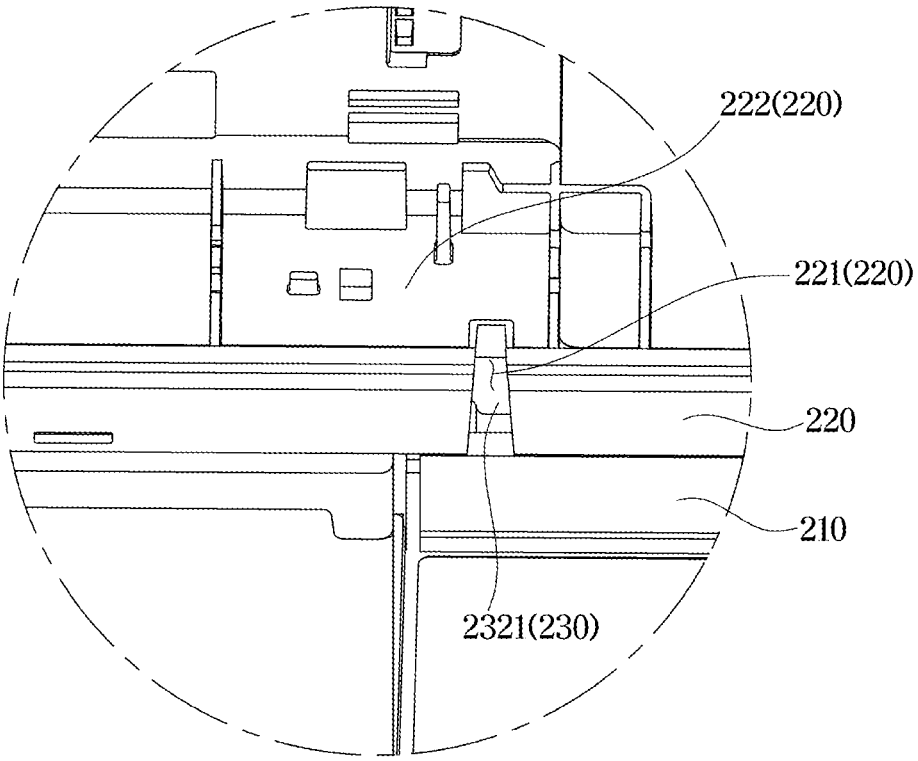
FIG. 15 is an enlarged view of a portion C of FIG. 14 when viewed from the rear upper side.

FIG. 14 is a rear-perspective view of the first partition shown in FIG. 4. FIG. 15 is an enlarged view of a portion C of FIG. 14 when viewed from the rear upper side.

Referring to FIGS. 14 and 15, the refrigerator 1 may include the temperature sensor 81 (refer to FIG. 6) mounted on the lower surface of the second partition 200 to detect the temperature of the second storage compartment 32.

The second partition 200 may include the cutout 221 that is cut to allow the wire, which is connected to the temperature sensor 81, to pass and to be guided to the rear of the first storage compartment 31.

The second partition 200 may include the wire receiving member 222 formed on the upper surface to receive the wire passing through the cutout 221.

The second partition 200 may include the water tank mounting member 223 provided on the upper surface of the second partition 200 to allow the water tank 60 to be mounted thereon. The water tank mounting member 223 may be provided in front of the wire receiving member 222.

Although not shown, the water tank 60 may be connected to a plurality of hoses for receiving water from an external water supply source and supplying filtered water. The plurality of hoses may extend backward from the water tank 60 and be guided to the outside of the inner case 11. A water tank cover (not shown) provided to cover an accessory of the water tank 60 such as a hose may be arranged inside the refrigerator 1. The water tank cover (not shown) may be mounted on the rear of the water tank 60.

As for the first storage compartment 31 corresponding to a refrigerating compartment, the wire received in the wire receiving member 222 through the cutout 221 may be exposed to the cold air of the refrigerating compartment and the cold air may be transmitted along the wire, thereby causing dew formation. Therefore, it is required to cover the wire (not shown) and a wire housing (not shown) so as to prevent the dew formation.

As for the refrigerator 1 according to an embodiment of the disclosure, the wire receiving member 222 may be formed at the rear of the water tank mounting member 223 so as to allow the water tank cover arranged at the rear of the water tank 60 to simultaneously cover the wire and the wire housing without a separate cover member. Accordingly, it is possible to provide a relatively simple covering structure.

However, the position of the first partition 100 and the second partition 200 of the refrigerator 1 according to an embodiment of the disclosure is not limited to the above-described example.

Particularly, as the shape of the inner case 11 is deformed, cold air may be supplied from the second cold air supplier 80 arranged in the first storage compartment 31 to the second storage compartment 32. At this time, the first inner case 11*a* may include the first storage compartment 31, and the second inner case 11*b* may be separated to include the second storage compartment 32 and the third storage compartment 33.

Accordingly, the first partition 100 may be arranged between the first inner case 11*a* and the second inner case 11*b* and particularly, arranged between the first storage compartment 31 and the second storage compartment 32. The second partition 200 may be arranged to define the second storage compartment 32 and the third storage compartment 33.

That is, the second cold air supplier 80 of the first storage compartment 31 may be configured to selectively supply cold air to the second storage compartment 32. Accordingly, the positions of the first partition 100 and the second partition 200 of the refrigerator 1 according to an embodiment of the disclosure may be changed.

For example, the first partition 100 may include a first guide duct 110 receiving cold air from the second cold air supplier 80 and communicating with the second partition 200, and the second partition 200 may include a second guide duct 231 communicating with the first guide duct 110 to guide cold air to the second storage compartment 32. At this time, the second guide duct 231 of the second partition 200 may extend upward from the rear of the second storage compartment 32.

As is apparent from the above description, by forming a guide duct in each partition, cold air may flow in a shortest flow path, and a cooling efficiency of a storage compartment may be increased.

In addition, it is possible to prevent a wire from being exposed to an outside, without providing a separate configuration for covering the wire connected to a temperature sensor.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body comprising an inner case, the inner case comprising:

a first storage compartment formed therein;

a second storage compartment formed below the first storage compartment; and a third storage compartment formed below the second storage compartment;

a first partition arranged between the second storage compartment and the third storage compartment;

a second partition arranged between the first storage compartment and the second storage compartment so that the second storage compartment is formed between the first partition and the second partition;

a cold air supplier arranged in the third storage compartment to generate cold air, the cold air supplier comprising a damper mounted to an inside of the cold air supplier to control a flow of the cold air coming out of the cold air supplier to the second storage compartment;

a first guide duct formed in the first partition, and the first guide duct comprising a first flow space formed therein; and a second guide duct formed in the second partition, comprising a second flow space formed therein, and connected to the first guide duct, wherein in response to the damper being an open state, the cold air from the cold air supplier flows to the second storage compartment through the first guide duct and the second guide duct, and in response to the damper being a close state, the cold air from the cold air supplier is blocked by the damper and not supplied to the first guide duct and the second guide duct.

2. The refrigerator of claim 1, further comprising:

an outer case arranged on an outside of the inner case, wherein the first partition is arranged between the inner case and the outer case and the second partition is arranged inside the inner case.

3. The refrigerator of claim 1, wherein the cold air supplier, the first guide duct and the second guide duct are arranged side by side in a vertical direction.

4. The refrigerator of claim 1, further comprising:

a temperature sensor mounted to a lower surface of the second partition to detect a temperature of the second storage compartment, wherein the second partition comprises:

a cutout portion which has been cut out to allow a wire, which is connected to the temperature sensor, to pass therethrough and to be guided to a rear side of the first storage compartment; and a wire receiving member formed on an upper surface of the second partition to receive the wire passing through the cutout portion.

5. The refrigerator of claim 4, wherein the second partition further comprises a water tank mounting member formed on the upper surface of the second partition to allow a water tank to be mounted thereon, the water tank mounting member arranged in front of the wire receiving member.

6. The refrigerator of claim 1, wherein the first partition further comprises an insulating body arranged in front of the first guide duct to allow the first guide duct to be coupled thereto, the insulating body having a first flow space formed therein and through which the generated cold air flows together with the first guide duct.

7. The refrigerator of claim 6, wherein the first guide duct comprises:

a base; and a flow path forming member extending from the base to the insulating body form the first flow space therein.

8. The refrigerator of claim 7, wherein the first guide duct further comprises:

a first cold air inlet through which the generated cold air is introduced from the cold air supplier; and a first cold air outlet formed above the first cold air inlet to allow the cold air which is introduced to the first cold air inlet, to flow to the second guide duct therethrough, the first cold air outlet arranged to be inclined with respect to the first cold air inlet.

9. The refrigerator of claim 1, wherein the inner case comprises:

a first inner case including the first storage compartment and the second storage compartment respectively formed therein;

a second inner case arranged below the first inner case and including the third storage compartment formed therein;

a first communication hole formed on one surface of the second inner case; and a second communication hole formed on one surface of the first inner case, the first guide duct is arranged between the first inner case and the second inner case, and the first guide duct and the second guide duct respectively connected to the second communication hole and the first communication hole.

10. The refrigerator of claim 9, wherein the first communication hole is formed in a portion of the second inner case which has been cut out, and to allow the first guide duct to communicate with the third storage compartment therethrough, and the second communication hole is formed in a portion of the first inner case which has been cut out, and to allow the first guide duct to communicate with the second guide duct therethrough.

11. The refrigerator of claim 10, wherein the cold air supplier is arranged at a rear of the third storage compartment and to supply the cold air to the first guide duct through the first communication hole.

12. The refrigerator of claim 10, wherein the first communication hole is formed on an upper surface of the second inner case and the second communication hole is formed on a lower surface of the first inner case.

13. The refrigerator of claim 10, wherein the second guide duct extends downward toward the first guide duct to communicate with the second communication hole.

14. A refrigerator comprising:

an inner case including a first inner case and a second inner case, the first inner case including: a first storage compartment formed therein; and the second inner case including a second storage compartment formed therein and below the first storage compartment, and the second inner case further including a third storage compartment formed therein and below the second storage compartment;

a first partition arranged between the first inner case and the second inner case;

a second partition arranged inside the first inner case, and to define the first storage compartment and the second storage compartment;

a cold air supplier mounted on the third storage compartment to generate cold air, and to communicate with the first partition, the cold air supplier comprising a damper mounted to an inside of the cold air supplier to control a flow of the cold air coming out of the cold air supplier to the second storage compartment;

a first guide duct formed in the first partition and including a first flow space formed therein and through which the cold air generated by the cold air supplier, flows, and a second guide duct formed in the second partition to communicate with the first guide duct, and including a second flow space formed therein and through which the cold air guided along the first flow space, flows, wherein in response to the damper being an open state, the cold air from the cold air supplier flows to the second storage compartment through the first guide duct and the second guide duct, and in response to the damper being a close state, the cold air from the cold air supplier is blocked by the damper and not supplied to the first guide duct and the second guide duct.

15. The refrigerator of claim 14, wherein the second guide duct. extends downward toward the first guide duct at a rear of the second storage compartment, and the cold air guided to the second flow space is discharged to the second storage compartment.

16. The refrigerator of claim 15, wherein the second inner case includes a first communication hole formed on an upper surface thereof to connect the cold air supplier to the first guide duct, and the first inner case includes a second communication hole formed on a lower surface thereof to connect the first guide duct to the second guide duct.

17. A refrigerator comprising:

an inner case having a first storage compartment formed therein;

a second storage compartment formed therein and below the first storage compartment; and a third storage compartment formed therein and below the second storage compartment;

a cold air supplier mounted on the third storage compartment, the cold air supplier comprising a damper mounted to an inside of the cold air supplier to control a flow of cold air coming out of the cold air supplier to the second storage compartment;

a first partition arranged outside the inner case and between the second storage compartment and the third storage compartment, the first partition including a first guide duct to communicate with the cold air supplier to allow the cold air generated by the cold air supplier, to flow therethrough; and a second partition mounted on an inside of the inner case to define the first storage compartment and the second storage compartment, the second partition including a second guide duct having one end thereof communicates with the first guide duct and an other end thereof communicates with the second storage compartment, wherein in response to the damper being an open state, the cold air from the cold air supplier flows to the second storage compartment through the first guide duct and the second guide duct, and in response to the damper being a close state, the cold air from the cold air supplier is blocked by the damper and not supplied to the first guide duct and the second guide duct.

18. The refrigerator of claim 17, wherein the inner case includes:

a first communication hole formed therein to connect the cold air supplier to the first guide duct and formed in front of a rear surface of the inner case; and a second communication hole formed therein to connect the first guide duct to the second guide duct and formed in front of the rear surface of the inner case.

* * * * *